US010156802B2

(12) United States Patent
Kaneko et al.

(10) Patent No.: US 10,156,802 B2
(45) Date of Patent: Dec. 18, 2018

(54) TONER, TONER HOUSING UNIT, IMAGE FORMING APPARATUS, AND IMAGE FORMING METHOD

(71) Applicants: Akihiro Kaneko, Shizuoka (JP); Kazumi Suzuki, Shizuoka (JP); Yoshitaka Yamauchi, Shizuoka (JP); Yu Naito, Shizuoka (JP)

(72) Inventors: Akihiro Kaneko, Shizuoka (JP); Kazumi Suzuki, Shizuoka (JP); Yoshitaka Yamauchi, Shizuoka (JP); Yu Naito, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/339,059

(22) Filed: Oct. 31, 2016

(65) Prior Publication Data

US 2017/0139337 A1 May 18, 2017

(30) Foreign Application Priority Data

Nov. 18, 2015 (JP) ..... 2015-225929

(51) Int. Cl.

| | |
|---|---|
| ***G03G 9/09*** | (2006.01) |
| ***G03G 13/20*** | (2006.01) |
| ***G03G 9/08*** | (2006.01) |
| ***G03G 13/08*** | (2006.01) |
| ***G03G 9/087*** | (2006.01) |
| ***G03G 15/08*** | (2006.01) |
| ***G03G 15/01*** | (2006.01) |

(52) U.S. Cl.

CPC ..... *G03G 9/0926* (2013.01); *G03G 9/087* (2013.01); *G03G 9/0821* (2013.01); *G03G 9/0902* (2013.01); *G03G 13/08* (2013.01); *G03G 13/20* (2013.01); *G03G 15/01* (2013.01); *G03G 15/08* (2013.01)

(58) Field of Classification Search

CPC .. G03G 9/0926; G03G 9/0902; G03G 9/0821; G03G 15/08; G03G 13/08; G03G 13/20

See application file for complete search history.

(56) References Cited

U.S. PATENT DOCUMENTS

| | | | |
|---|---|---|---|
| 2004/0058260 | A1 | 3/2004 | Katoh et al. |
| 2005/0152707 | A1 | 7/2005 | Suzuki et al. |
| 2005/0254846 | A1 | 11/2005 | Yura et al. |
| 2006/0013604 | A1 | 1/2006 | Kadota et al. |
| 2006/0072943 | A1 | 4/2006 | Suzuki et al. |
| 2006/0088337 | A1 | 4/2006 | Nakazato et al. |
| 2007/0071511 | A1 | 3/2007 | Suzuki et al. |
| 2007/0098449 | A1 | 5/2007 | Kadota et al. |
| 2007/0160395 | A1 | 7/2007 | Kadota et al. |
| 2007/0212126 | A1 | 9/2007 | Seto et al. |
| 2007/0212129 | A1 | 9/2007 | Takemoto et al. |
| 2007/0218386 | A1 | 9/2007 | Suzuki et al. |
| 2008/0008505 | A1 | 1/2008 | Seto et al. |
| 2008/0063971 | A1 | 3/2008 | Watanabe et al. |
| 2008/0069606 | A1 | 3/2008 | Yamashita et al. |
| 2008/0069610 | A1 | 3/2008 | Nakafuji et al. |
| 2008/0248416 | A1 | 10/2008 | Norikane et al. |
| 2008/0286679 | A1 | 11/2008 | Norikane et al. |
| 2008/0286680 | A1 | 11/2008 | Norikane et al. |
| 2008/0292985 | A1 | 11/2008 | Suzuki et al. |
| 2009/0003898 | A1 | 1/2009 | Kayahara et al. |
| 2009/0016786 | A1 | 1/2009 | Suzuki et al. |
| 2009/0042118 | A1 | 2/2009 | Suzuki et al. |
| 2009/0116880 | A1 | 5/2009 | Takagaki et al. |
| 2009/0117486 | A1 | 5/2009 | Watanabe et al. |
| 2009/0239170 | A1 | 9/2009 | Honda et al. |
| 2009/0317738 | A1 | 12/2009 | Honda et al. |
| 2009/0325100 | A1 | 12/2009 | Watanabe et al. |
| 2010/0021195 | A1 | 1/2010 | Yura et al. |
| 2010/0021209 | A1 | 1/2010 | Watanabe et al. |
| 2010/0055590 | A1 | 3/2010 | Honda et al. |
| 2011/0008723 | A1 | 1/2011 | Morita et al. |
| 2011/0065036 | A1 | 3/2011 | Inoue et al. |
| 2011/0124838 | A1 | 5/2011 | Kotsugai et al. |
| 2011/0177447 | A1 | 7/2011 | Suzuki et al. |
| 2011/0218301 | A1 | 9/2011 | Nemoto et al. |
| 2012/0065357 | A1 | 3/2012 | Yamauchi et al. |
| 2012/0082926 | A1 | 4/2012 | Suzuki et al. |
| 2012/0129094 | A1 | 5/2012 | Yamauchi et al. |
| 2012/0202147 | A1 | 8/2012 | Suzuki et al. |
| 2012/0225377 | A1 | 9/2012 | Yamauchi et al. |
| 2012/0231383 | A1 | 9/2012 | Santo et al. |
| 2012/0288791 | A1 | 11/2012 | Sakashita et al. |
| 2012/0295188 | A1 | 11/2012 | Nakajima et al. |
| 2012/0322005 | A1 | 12/2012 | Tanaka et al. |
| 2013/0017480 | A1 | 1/2013 | Suzuki et al. |
| 2013/0065172 | A1 | 3/2013 | Moriya et al. |
| 2013/0149642 | A1 | 6/2013 | Sabu et al. |
| 2013/0157183 | A1 | 6/2013 | Santo et al. |
| 2013/0171550 | A1 | 7/2013 | Amemori et al. |
| 2013/0196263 | A1 | 8/2013 | Asahina et al. |
| 2013/0196266 | A1 | 8/2013 | Watanabe et al. |
| 2013/0202996 | A1 | 8/2013 | Yamauchi et al. |
| 2013/0236826 | A1 | 9/2013 | Makabe et al. |
| 2013/0244167 | A1 | 9/2013 | Yamashita et al. |
| 2013/0330522 | A1 | 12/2013 | Suzuki et al. |
| 2014/0080047 | A1 | 3/2014 | Takahashi et al. |

(Continued)

FOREIGN PATENT DOCUMENTS

| | | |
|---|---|---|
| JP | 62-127753 | 6/1987 |
| JP | 2010-256613 | 11/2010 |
| JP | 2013-057906 | 3/2013 |
| JP | 2014-106280 | 6/2014 |
| JP | 2014-157249 | 8/2014 |

OTHER PUBLICATIONS

Diamond, A.S. ed., et al., Handbook of Imaging Materials, second edition, Marcel Dekker, Inc., NY (2002), pp. 146-148.*

*Primary Examiner* — Janis L Dote

(74) *Attorney, Agent, or Firm* — Oblon, McClelland, Maier & Neustadt, L.L.P.

(57) ABSTRACT

A toner includes a binder resin; and a plate-shaped pigment having a silica coated layer on the surface, an average-particle diameter of from 10 μm to 25 μm, and an aspect ratio of from 20 to 125.

8 Claims, 1 Drawing Sheet

(56) References Cited

U.S. PATENT DOCUMENTS

| | | | | |
|---|---|---|---|---|
| 2014/0080050 | A1 | 3/2014 | Asahina et al. | |
| 2014/0272690 | A1 | 9/2014 | Suzuki et al. | |
| 2014/0342284 | A1 | 11/2014 | Moriya et al. | |
| 2014/0342286 | A1 | 11/2014 | Yamauchi et al. | |
| 2015/0030819 | A1 | 1/2015 | Naito et al. | |
| 2015/0037718 | A1 | 2/2015 | Morita et al. | |
| 2015/0153671 | A1 | 6/2015 | Yamauchi et al. | |
| 2015/0212444 | A1 | 7/2015 | Yamauchi et al. | |
| 2015/0220011 | A1 | 8/2015 | Miyaake et al. | |
| 2015/0248074 | A1 | 9/2015 | Suzuki et al. | |
| 2015/0253685 | A1 | 9/2015 | Suzuki et al. | |
| 2015/0253688 | A1 | 9/2015 | Yamauchi et al. | |
| 2016/0011533 | A1* | 1/2016 | Hara | G03G 9/09342 430/105 |
| 2017/0255117 | A1* | 9/2017 | Hirai | G03G 9/0819 |

* cited by examiner

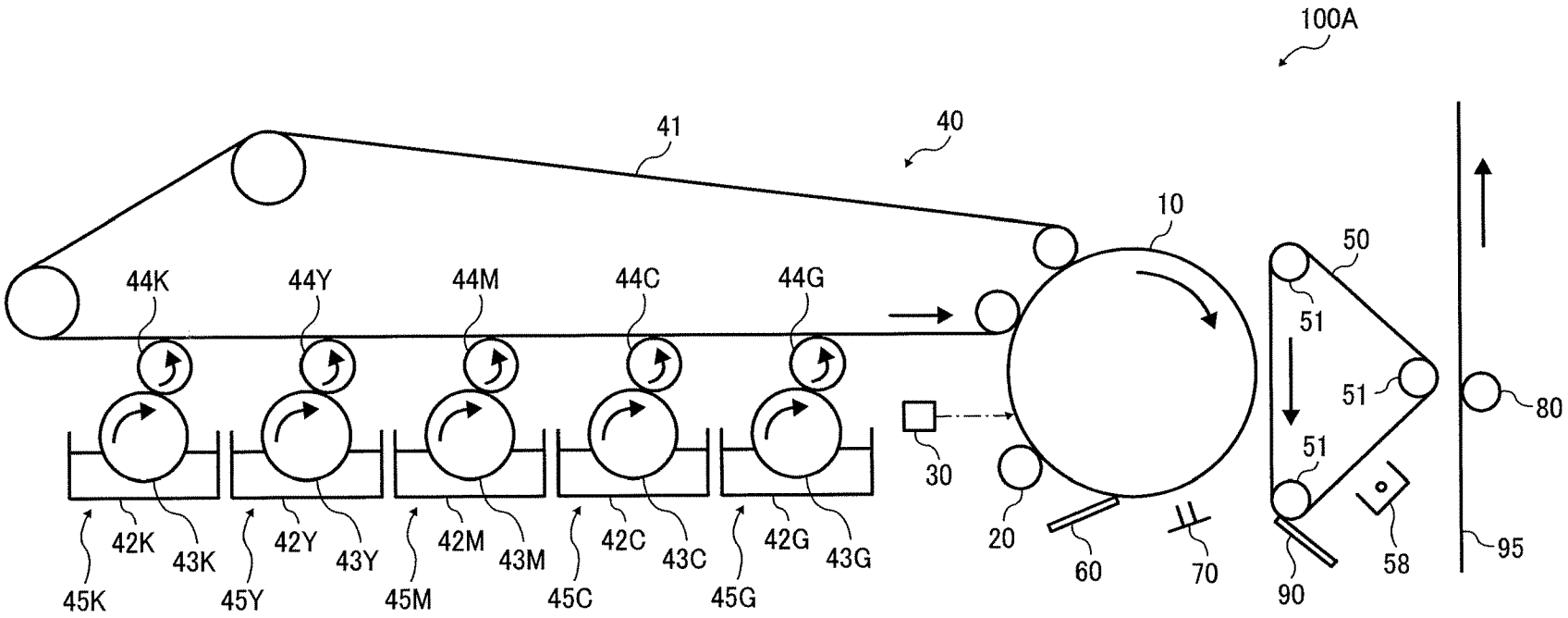
100A
80
95
50
51
51
51
58
90
10
70
60
20
30
40
41
44G
43G
42G
45G
44C
43C
42C
45C
44M
43M
42M
45M
44Y
43Y
42Y
45Y
44K
43K
42K
45K

TONER, TONER HOUSING UNIT, IMAGE FORMING APPARATUS, AND IMAGE FORMING METHOD

CROSS-REFERENCE TO RELATED APPLICATIONS

This patent application is based on and claims priority pursuant to 35 U.S.C. § 119 to Japanese Patent Application No. 2015-225929, filed on Nov. 18, 2015, in the Japan Patent Office, the entire disclosure of which is hereby incorporated by reference herein.

BACKGROUND

Technical Field

The present invention relates to a toner, a toner housing unit, an image forming apparatus, and an image forming method.

Description of the Related Art

A toner set which is a combination of a black toner with three-color process toners, that is, a cyan toner, a magenta toner, a yellow toner, is typically used to form a full-color image by the electrophotographic method.

In forming an image of each color, light reflected from a document is irradiated on a photoconductor through a color separation filter or an image read by a scanner is written with a laser irradiation on a photoconductor to form an electrostatic latent image thereon. While an order of the toner images for forming the full-color image is not limited, in one example, an electrostatic yellow latent image is developed with a yellow toner to form a yellow toner image, and the yellow toner image is transferred onto a recording medium such as papers. Similarly, a magenta toner image, a cyan toner image and a black toner image are formed with a magenta toner, a cyan toner and a black toner, respectively and sequentially overlapped on the yellow toner image one above the other to form the full-color image.

However, as the electrophotographic full-color image forming apparatuses become widely used, their applications multifariously expand. For example, metallic images are demanded in addition to conventional color images.

To form metallic images having brightness like metals have, bright toner including metallic pigments in their binder resins are used, and the brightness is controlled by various methods.

SUMMARY

In one embodiment, a toner includes a binder resin and a plate-shaped pigment having a silica coated layer on the surface. The pigment has an average particle diameter of from 10 μm to 25 μm, and an aspect ratio of from 20 to 125.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIGURE is a schematic view of an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

Accordingly, one object of the present invention is to provide a toner having high brightness at a wide range of fixable temperature, as described below.

Another object of the present invention is to provide a toner housing unit housing the toner therein.

A further object of the present invention is to provide an image forming apparatus using the toner.

Another object of the present invention is to provide an image forming method using the toner.

(Toner)

The toner of the present invention includes at least a binder resin and a plate-shaped pigment in the binder resin.

The plate-shaped pigment has an average particle diameter of from 10 μm to 25 μm, and an aspect ratio of from 20 to 125.

The toner has high brightness at a wide range of fixable temperature.

The toner of the present invention includes at least a binder resin and a plate-shaped pigment, and further includes a release agent and other components when necessary. The toner of the present invention is a bright toner. The brightness is a visible metallic glossiness of an image formed by the toner.

<Binder Resin>

The binder resins are not particularly limited, and conventionally-used resins can be used if soluble in organic solvent. Among them, polyester resins are preferably used.

The polyester resins can be obtained by polycondensation reaction between known alcohols and acids.

Specific examples of the alcohols include, but are not limited to diols such as polyethylene glycol, diethylene glycol, triethylene glycol, 1, 2-propylene glycol, 1, 3-propylene glycol, 1, 4-propylene glycol, neopentyl glycol and 1, 4-butenediol; etherified bisphenol A such as 1, 4-bis(hydroxymethyl)cyclohexane, bisphenol A, hydrogenated bisphenol A, polyoxyethylenated bisphenol A, polyoxypropylenated bisphenol A; their dihydric alcoholic monomers substituted with a saturated or unsaturated hydrocarbon group having 3 to 22 carbon atoms; other dihydric alcoholic monomers; and multivalent alcoholic monomers having 3 or more valences such as sorbitol, 1, 2, 3, 6-hexanetetrol, 1, 4-sorbitan, pentaerythritol, dipentaerythritol, tripentaerythritol, saccharose, 1, 2, 4-butanetriol, 1, 2, 5-pentanetriol, glycerol, 2-methylpropanetriol, 2-methyl-1, 2, 4-butanetriol, trimethylol ethane, trimethylol propane and 1, 3, 5-trihydroxymethylbenzene.

Specific examples of the acids include, but are not limited to, monocarboxylic acids (e.g., palmitic acid, stearic acid, oleic acid), maleic acid, fumaric acid, mesaconic acid, citraconic acid, terephthalic acid, cyclohexane dicarboxylic acid, succinic acid, adipic acid, sebacic acid, malonic acid, divalent organic acids in which the above compounds are substituted with a saturated or unsaturated hydrocarbon group having 3 to 22 carbon atoms, anhydrides and lower esters of the above compounds, dimer acids of linoleic acid, and tri- or more valent carboxylic acids (e.g., 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)

methane, 1,2,7,8-octanetetracarboxylic acid enpol trimmer acid, and anhydrides of these compounds).

The polyester resin in the binder resin preferably has a weigh-average molecular weight (Mw) of from 9,500 to 30,000, and a number-average molecular weight (Mn) of from 2,100 to 2,300.

<<Other Binder Resins>>

The toner may include other binder resins besides the polyester resins. Specific examples of the other binder resins include, but are not limited to, epoxy resins, polyurethane resins, polyamide resins, and styrene acrylic copolymers. These resins may be used alone or in combination.

<Plate-Shaped Pigment>

The plate-shaped pigment has an average particle diameter of from 10 μm to 25 μm, and preferably from 13 μm to 21 μm. When less than 10 μm, not only it is difficult to uniform orientation of the pigment when the toner is fixed, but also the toner deteriorates in brightness because spaces tend to be made between the pigments in images.

When greater than 25 μm, the pigments are overlapped when the toner is fixed, resulting in loss of brightness.

The plate-shaped pigment has an aspect ratio (particle diameter/thickness) of from 20 to 125, and preferably from 40 to 100. When less than 20, the pigment is closer to a sphere and loses brightness.

When greater than 125, the pigments bend when the toner is fixed, resulting in loss of brightness.

The plate-shaped pigment is coated with silica and has a silica-coated layer on the surface. When not coated with silica, the pigments which bend increase when the toner is fixed, resulting in loss of brightness.

Specific examples of the plate-shaped pigment include, but are not limited to, TCR series from Toyo Aluminium K.K.

The toner preferably includes the plate-shaped pigment in an amount of from 3 to 11 parts by mass, and more preferably from 5 to 11 parts by mass.

Whether a pigment has a silica-coated layer on the surface can be confirmed by EDS (element analysis) measurement using a scanning electron microscope Zeiss Ultra 55 from Carl Zeiss Microscopy GmbH. In this example of the present invention, the silica-coated layer preferably has a thickness about 0.02 μm.

Methods of preparing an aluminum pigment for use in the present invention are not particularly limited, and known methods can be used. For example, an aluminum powder is pulverized by a ball mill or an attritor mill under the presence of a pulverization catalyst with a pulverization aid such as fatty acids to obtain a pigment having a desired particle diameter and a desired thickness.

Methods of coating the surface of the aluminum pigment with silica include, e.g., dispersing the pigment in propylene glycol monomethyl ether to prepare a dispersion; adding tetraethoxysilane, aqueous ammonia and water thereto, and stirring the dispersion.

[Measurements of Average Particle Diameter and Aspect Ratio (Particle Diameter/Thickness) of Pigment]

An average particle diameter and an aspect ratio (particle diameter/thickness) of the pigment can be measured with a scanning electron microscope ZEISS ULTRA 55 from Carl Zeiss Microscopy GmbH.

The obtained images are digitalized with an image analysis software such as A zou kun from Asahi Kasei Engineering Corp. to determine an area of the pigment.

The average particle diameter is from the area regarded as a circle.

The thickness is measured as follows. After the toner is dissolved in a soluble solvent such as tetrahydrofuran such that each of the pigments faces the same direction, the solution is coated on a polyester film by spin coating and dried. After the coated film is buried in an epoxy resin, a slice thereof is formed by an ultramicrotome ULTRACUT-S (from Leica), and a cross-section of the toner is observed to measure the thickness.

<Properties of Toner>

The toner of the present invention preferably has a volume-average particle diameter (Dv) about 1.2 to 2.0 times of the average particle diameter of the pigment. When too large, a contrast ratio of the pigment decreases to impair brightness. When too small, the pigment protrudes to impair functions of the toner.

When a temperature at which the toner has a storage modulus G' of $1\times10^4$ (Pa) is T1 and a temperature at which the toner has a storage modulus G' of $1\times10^2$ (Pa) is T2, T2−T1 is preferably not less than 30° C.

The storage modulus G' has a relation with a resin molecular weight. As the molecular weight decreases, T2−T1 tends to decrease. When a toner having a resin molecular weight such that T2−T1 is not less than 30° C., a fixable temperature width providing good brightness can be widened.

[Method of Measuring Storage Modulus G' of Toner]

The storage modulus G' in this disclosure can be measured by a viscoelasticity measurer (rheometer) RDA-II from Rheometrics.

Measuring jig: parallel plate having a diameter of 7.9 mm

Sample measured: the toner is pressed to have the shape of a cylinder having a diameter about 8 mm and a height of 3 mm Measuring frequency: 1 (Hz)

Measuring temperature: 40° C. to 200° C.

Measurement distortion: initial value is 0.1% and automatic measuring mode is used Elongation correction of sample: controlled by automatic measuring mode The toner of the present invention preferably has a weight-average molecular weight (Mw) of from 9,000 to 29,000, and a number-average molecular weight of from 1,900 to 2,400.

[Measurement of Molecular Weight of Toner]

The number-average molecular weight and the weight-average molecular weight of the toner can be measured by measuring a molecular weight distribution of THF-soluble components thereof with a GPC (gel permeation chromatography) measurer GPC-150C from Waters Corp.

A column (KF801 to 807 from Shodex) is stabilized in a heat chamber having a temperature of 40° C.; THF is put into the column at a speed of 1 ml/min as a solvent; 0.05 g of the binder resin is fully dissolved in 5 g of THF and the solution is filtered through a filter such as CHROMATODISC having a pore diameter of 0.45 μm from Kurabo Industries, Ltd.; and, finally 50 μL to 200 μL of a THF liquid-solution of a resin, having a sample concentration of from 0.05 to 0.6% by weight, is put into the column to measure. A molecular weight distribution of the sample is determined by using a calibration curve which is previously prepared using several polystyrene standard samples having a single distribution peak, and which shows the relationship between a count number and the molecular weight.

As the standard polystyrene samples for making the calibration curve, for example, the samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ from Pressure Chemical Co. or Tosoh Corporation are used. It is preferable to use at least 10 standard polystyrene samples. In addition, an RI (refraction index) detector is used as the detector.

<Other Components>

The toner of this disclosure preferably includes a release agent.

Specific examples of the release agent include, but are not limited to, low-molecular-weight polyolefin waxes such as low-molecular-weight polyethylene and low-molecular-weight polypropylene; carbon hydride waxes such as a Fischer-Tropsch wax; natural waxes such as a bees wax, a carnauba wax, a candelilla wax, a rice wax, a Montan wax; petroleum waxes such as a paraffin wax and a microcrystalline wax; higher fatty acids such as a stearic acid, a palmitic acid, a myristic acid and their metallic salts; higher fatty acid amide; synthetic ester waxes and their modified waxes. These may be used alone or in combination.

The toner preferably includes the release agent in an amount of from 5 to 10 parts by mass, and more preferably from 6 to 9 parts by mass.

The release agent is preferably dispersed in a binder resin while coated with a pigment.

When not less than 5 parts by mass, a problem that the pigment is difficult to move in the toner and the pigment deteriorates in smoothness when the toner is fixed is prevented. In addition, a problem that the release agent does not exude enough on the surface of the toner when fixed to deteriorate in releasability and the fixable temperature width is narrowed is prevented. When not greater than 10 parts by mass, a problem that increase of the release agent in the toner deteriorates smoothness and crowdedness of the pigment when the toner is fixed is prevented. In addition, a problem that the release agent exuding on the surface of the toner increases to narrow fixable temperature width capable of imparting brightness to the toner and deteriorate stability (preservability) thereof is prevented.

Unless the pigment is coated with the release agent, the pigment decreases in flexibility and smoothness when the toner is fixed. The wax is unevenly dispersed in the toner to narrow fixable temperature width capable of imparting brightness thereto.

Whether a pigment is coated with the release agent can be confirmed by burying the toner in an epoxy resin formed by mixing two liquids, forming a slice thereof with an ultramicrotome ULTRACUT-S (from Leica), and observing a cross-section of the slice with a scanning electron microscope Zeiss Ultra 55 from Carl Zeiss Microscopy GmbH. Here, the surface of the pigment is partly or entirely coated with the release agent.

<Method of Preparing Toner>

The toner of the present invention may be prepared by preparing toner particles and then adding external additives thereto.

Known dry methods such as kneading and pulverizing methods and wet methods such as dissolution suspension methods and emulsion aggregation methods can be used to prepare the toner particles.

(Toner Housing Unit)

The toner housing unit in the present invention is a unit capable of housing a toner containing toner. Specific examples thereof include, but are not limited to, toner housing containers, image developers, and process cartridges.

The toner housing container contains a toner.

The image developer contains a toner and has a means of developing. The process cartridge includes at least an image bearer and an image developer in a body and contains a toner, which is detachable from image forming apparatus. The process cartridge may further include at least one of a charger, an irradiator and a cleaner.

An image forming apparatus equipped with the toner housing unit of the present invention is capable of taking advantage of the toner having high brightness at a wide fixable temperature range.

(Image Forming Apparatus and Image Forming Method)

An image forming apparatus of the present invention includes at least an electrostatic latent image bearer, an electrostatic latent image forming unit, and an image developer, and if necessary, further includes other units.

An image forming method of the present invention includes at least an electrostatic latent image forming step and a developing step, and if necessary, further includes other steps.

The image forming method can preferably be executed by the image forming apparatus, the electrostatic latent image forming step can preferably be executed by the electrostatic latent image forming unit, the developing step can preferably be executed by the image developer, and the other steps can preferably be executed by the other units.

The image forming apparatus of the present invention more preferably includes an electrostatic latent image bearer, an electrostatic latent image forming unit to form an electrostatic latent image on the electrostatic latent image bearer, an image developer including a toner to develop the electrostatic latent image formed on the electrostatic latent image bearer with the toner to form a toner image, a transferring unit to transfer the toner image formed on the electrostatic latent image bearer onto the surface of a recording medium, and a fixing unit to fix the toner image formed on the recording medium thereon.

The image forming method of the present invention more preferably includes an electrostatic latent image forming process of forming an electrostatic latent image on an electrostatic latent image bearer, a developing process of developing the electrostatic latent image formed on the electrostatic latent image bearer with the toner to form a toner image, a transferring process of transferring the toner image formed on the electrostatic latent image bearer onto the surface of a recording medium, and a fixing process of fixing the toner image formed on the recording medium thereon.

The toner is used in the image developer and the developing process. A developer including the toner, and other components such as a carrier when necessary is preferably used to form the toner image.

In the image forming method of the present invention, the toner preferably has a number density of from 84,000 to 1,400,000 pieces/$cm^2$, and more preferably from 100,000 to 1,250,000 pieces/$cm^2$ on a recording medium before fixed to produce images having good brightness.

When not less than 84,000 pieces/$cm^2$, a problem that a pigment decreases in concealment and brightness is impaired is effectively prevented. When not greater than 1,400,000 pieces/$cm^2$, a problem that the pigments are overlapped when the toner is fixed and brightness is impaired is effectively prevented.

The toner on a recording medium before fixed preferably has a standard deviation (unevenness) of distances between particles not greater than 0.7, and more preferably not greater than 0.5.

When not greater than 0.7, a problem that the toner particles are eccentrically present on a recording medium, concealment of the pigment and overlapping of the pigments increase, and brightness is impaired is effectively prevented.

[Measurement of Number Density of Toner on Recording Medium Before Fixed and Distances Between Toner Particles]

The number density of the toner on a recording medium before fixed and distances between the toner particles can be measured with an optical microscope ZEISS Imager AX10 from Carl Zeiss Microscopy GmbH.

The obtained images are digitalized with an image analysis software such as A zou kun from Asahi Kasei Engineering Corp. and calculate numbers and distances between centers of the bright toners to measure the number density and the standard deviation of distances between the toner particles.

In the fixing process, a fixing nip time is preferably from 20 ms to 60 ms, and a fixing pressure is preferably from 15 $N/cm^2$ to 30 $N/cm^2$. When at least either the fixing nip time or the fixing pressure is too large, the pigment bends when the toner is fixed, resulting in deterioration of brightness. In addition, the fixable temperature width is narrowed and the temperature width capable of producing images having good brightness decreases. When at least either the fixing nip time or the fixing pressure is too small, the orientation of the pigment when the toner is fixed deteriorates and the temperature width capable of producing images having good brightness and bright-looking decreases.

Since the image forming method of the embodiments of the present invention is specified in terms of both pigment materials and image forming methods, a wider fixable temperature width capable of producing images having high brightness can stably be obtained.

[Fixing Nip Time and Fixing Pressure]

The fixing nip time is determined from a nip width (mm) and a linear speed (mm/s). The nip width (mm) is measured by feeding an OHP film having a recording paper width to a fixer fully warmed up in synchronization with rotation of the roller, and stooping the fixer on the way to measure a white opaque part of the OHP film with a scale. Then, 10 mm to 20 mm inside from both ends and the center of the fixer are measured.

The fixing pressure ($N/cm^2$) can be measured using a surface pressure distribution system I-SCAN from Nitta Corp.

An embodiment of the image forming apparatus of the present invention is explained with reference to an accompanying drawing, referring to FIGURE. A color image forming apparatus 100A illustrated in the drawing includes a photoconductor drum 10 (hereinafter may be referred to as "photoconductor 10") serving as the electrostatic latent image bearer, a charging roller 20 serving as a charger, an irradiator 30 serving as an irradiator, an image developer 40 serving as an image developer, an intermediate transferer 50, a cleaner 60 including a cleaning blade serving as a cleaning blade, and a charge-eliminating lamp 70 serving as the charge-eliminating unit.

The intermediate transferer 50, which is an endless belt, is stretched around three rollers 51 disposed in the belt, and is designed to be movable in a direction indicated by the arrow. A part of three rollers 51 also functions as a transfer bias roller which can apply a predetermined transfer bias (primary transfer bias) to the intermediate transferer 50. Near the intermediate transferer 50, a cleaner 90 including a cleaning blade is disposed. Also, a transfer roller 80 serving as a transferer which can apply a transfer bias onto a transfer paper 95 serving as a recording medium for transferring (secondary transferring) an developed image (toner image) is disposed facing the intermediate transferer 50. Around the intermediate transferer 50, a corona charger 58 for applying a charge to the toner image on the intermediate transferer 50 is disposed between a contact portion of the photoconductor 10 with the intermediate transferer 50 and a contact portion of the intermediate transferer 50 with the transfer paper 95 in a rotational direction of the intermediate transferer 50.

The image developer 40 is composed of a developing belt 41 serving as a developer bearing member; and a black image developer 45K, a yellow image developer 45Y, a magenta image developer 45M, and a cyan image developer 45C, and a metallic image developer 45G which are disposed around the developing belt 41. Note that, the black image developer 45K includes a developer housing unit 42K, a developer supplying roller 43K, and a developing roller 44K. The yellow image developer 45Y includes a developer housing unit 42Y, a developer supplying roller 43Y, and a developing roller 44Y. The magenta image developer 45M includes a developer housing unit 42M, a developer supplying roller 43M, and a developing roller 44M. The cyan image developer 45C includes a developer housing unit 42C, a developer supplying roller 43C, and a developing roller 44C. The metallic image developer 45G includes a developer housing portion 42G, a developer supplying roller 43G and a developing roller 44G. Moreover, the developing belt 41, which is an endless belt, is stretched so as to be movable around a plurality of belt rollers, and a part of the developing belt 41 contacts with the electrostatic latent image bearer 10.

An embodiment of the image forming method is explained.

Image data transferred to an image processing unit (hereinafter referred to as IPU) are converted to five color image signals, i.e., Y (yellow), M (magenta), C (cyan), Bk (black) and G (metallic).

The Y, M, C, Bk and G color image signals are transferred to a writing unit. The writing unit modulates the Y, M, C, Bk and G image signals to form laser beams thereof and sequentially scans photoconductors therewith after they are charged by chargers to form electrostatic latent images on the respective photoconductors. In this embodiment, the first photoconductor drum is for Bk color image, the second photoconductor drum is for Y color image, the third photoconductor drum is for M color image, the fourth photoconductor drum is for C color image and the fifth photoconductor drum is for G (metallic) color image.

Next, image developers form toner images having each color on the photoconductor drums, respectively. A transfer paper fed from a paper feeder and on a transfer belt, and transfer chargers sequentially transfer the toner images on the photoconductor drums onto the transfer paper.

After the transfer process, the transfer paper is fed to a fixing unit, where the toner image is fixed on the transfer paper.

After the fixing process, toners remaining on the photoconductor drums are removed by cleaners, respectively.

EXAMPLES

Having generally described this invention, further understanding can be obtained by reference to certain specific examples which are provided herein for the purpose of illustration only and are not intended to be limiting. In the descriptions in the following examples, the numbers represent mass ratios in parts or %, unless otherwise specified.

Resin Preparation Example

[Polyester Resin 1]

A reaction container equipped with a condenser, a stirrer and a nitrogen inlet pipe was charged with 258 parts of bisphenol A propylene oxide 2 mol adduct and 1,344 parts of bisphenol A ethylene oxide 2 mol adduct, 800 parts of terephthalic acid and 1.8 parts of tetrabutoxy titanate as a condensation catalyst, and they were reacted under a nitrogen stream at 230° C. for 6 hrs while water being produced was removed. Next, the reaction product was reacted under reduced pressure of from 5 mmHg through 20 mmHg for 1 hr, and after cooled to 180° C., 10 parts of trimellitic anhydride were added thereto under reduced pressure of from 10 mmHg through 20 mmHg to obtain a polyester resin 1 having a weight-average molecular weight of 30,000 and a number-average molecular weight of 6,600.

[Polyester Resin 2]

A reaction container equipped with a condenser, a stirrer and a nitrogen inlet pipe was charged with 258 parts of bisphenol A propylene oxide 2 mol adduct and 1,344 parts of bisphenol A ethylene oxide 2 mol adduct, 768 parts of terephthalic acid and 1.8 parts of tetrabutoxy titanate as a condensation catalyst, and they were reacted under a nitrogen stream at 230° C. for 6 hrs while water being produced was removed. Next, the reaction product was reacted under reduced pressure of from 5 mmHg through 20 mmHg for 1 hr, and after cooled to 180° C., 10 parts of trimellitic anhydride were added thereto under reduced pressure of from 10 mmHg through 20 mmHg to obtain a polyester resin 2 having a weight-average molecular weight of 16,000 and a number-average molecular weight of 3,500.

[Polyester Resin 3]

A reaction container equipped with a condenser, a stirrer and a nitrogen inlet pipe was charged with 258 parts of bisphenol A propylene oxide 2 mol adduct and 1,344 parts of bisphenol A ethylene oxide 2 mol adduct, 731 parts of terephthalic acid and 1.8 parts of tetrabutoxy titanate as a condensation catalyst, and they were reacted under a nitrogen stream at 230° C. for 6 hrs while water being produced was removed. Next, the reaction product was reacted under reduced pressure of from 5 mmHg through 20 mmHg for 1 hr, and after cooled to 180° C., 10 parts of trimellitic anhydride were added thereto under reduced pressure of from 10 mmHg through 20 mmHg to obtain a polyester resin 2 having a weight-average molecular weight of 9,500 and a number-average molecular weight of 2,100.

<Method of Preparing Bright Toner Base Particle>

[Method of Preparing Bright (Pulverization) Toner Base Particle 1]

After the following toner materials were preliminarily mixed with HENSCHEL MIXER FM20B from Nippon Coke & Engineering, Co., Ltd., they were melted and kneaded at from 100° C. to 130° C. with a monoaxial kneader KO-KNEADER from Buss.

| | |
|---|---|
| Plate-shaped pigment 1 (an average particle diameter of 20 μm, an aspect ratio (particle diameter/thickness) of 50, silica coated, and non-leafing from Toyo Aluminum K. K). | 11 |
| Polyester resin 1 (Mw: 30,000, Mn: 6,600) | 79.1 |
| Styrene acrylic copolymer (EXD-001 from Sanyo Chemical Industries, Ltd., Tg 68° C., Mw13,000) | 4.5 |
| Monoester wax (mp 70.5° C.) | 5.4 |

The obtained kneaded mixture was cooled to room temperature and crushed to 200 μm to 300 μm with ROTOPLEX. Next, after the mixture was pulverized with a counter jet mil 100AFG from Hosokawa Micron Corp. while pulverization air pressure was appropriately adjusted so that a weight-average particle diameter was 26.5±0.3 μm, and classified with a current air classifier EJ-LABO from MATSUBO Corp. while a lower divergence was appropriately adjusted so that a weight-average particle diameter was 28±0.2 μm and a ratio of the weight-average particle diameter to the number-average particle diameter was 1.20 to obtain a bright toner base particle 1 having a Mw of 29, 000 and a Mn of 2, 400.

[Method of Preparing Bright Toner Base Particle 2]

—Preparation of Wax Dispersion—

A dispersion formed of the following compositions including a resin as a precursor of the binder resin and a wax was prepared.

On hundred (100) parts of the polyester resin 1 as a binder resin (H), 80 parts of monoester wax (mp 70.5° C.), 67 parts of a styrene acrylic copolymer (EXD-001 from Sanyo Chemical Industries, Ltd.) were mixed in 400 parts of ethyl acetate with a mixer having a stirring blade for 10 min, and dispersed for 8 hrs with DYNO-MILL to obtain a wax dispersion A having a wax dispersion diameter of 0.8 μm and including solid contents in an amount of 11.8%.

—Preparation of Fine Resin Particle Emulsion—

A reaction vessel equipped with a stirring bar and a thermometer was charged with 683 parts of water, 11 parts of a sodium salt of sulfuric acid ester of methacrylic acid-ethylene oxide adduct (ELEMINOL RS-30, product of Sanyo Chemical Industries, Ltd.), 79 parts of styrene, 79 parts of methacrylic acid, 105 parts of butyl acrylate, 13 parts of divinyl benzene and 1 part of ammonium persulfate, and the resultant mixture was stirred for 15 min at 400 rpm, to thereby obtain a white emulsion. The obtained emulsion was heated to have the system temperature of 75° C., and then was allowed to react for 5 hrs. To the resultant mixture, 30 parts of a 1% ammonium persulfate aqueous solution was added, followed by aging for 5 hrs at 75° C., to thereby obtain an aqueous dispersion liquid of a vinyl resin (a copolymer of styrene/methacrylic acid/sodium salt of sulfuric acid ester of methacrylic acid ethylene oxide adduct), i.e., [fine particle dispersion].

The [fine particle dispersion liquid] was measured by LA-920 (product of HORIBA, Ltd.), and as a result, a volume-average particle diameter thereof was found to be 105 nm. A part of the [fine particle dispersion liquid] was dried, to thereby isolate a resin content. The resin had a glass transition temperature (Tg) of 95° C., a number-average molecular weight of 140,000 and a weight-average molecular weight of 980,000.

<Preparation of Aqueous Medium Phase>

Ion-exchanged water (306 parts), 60 parts of the fine particle dispersion, 4 parts of sodium dodecyl benzene sulfonate were mixed and stirred to be uniformly be dissolved. Thus, an aqueous medium (phase) was prepared.

—Preparation of Toner Composition Liquid A—

After the following materials were dissolved, dispersed and stirred by CLEAMIX CLM-0.8S from M Technique Co., Ltd with R2 rotor at 10,000 rpm, the resultant mixture was dispersed by a nanomizer (medialess disperser from Yoshida Kikai Co., Ltd.) with a collision generator (aperture 100 μm) at a discharge pressure of 20 Mpa to obtain a toner composition liquid A.

| | |
|---|---|
| Polyester resin 1 (Mw: 30,000, Mn: 6,600) | 300 |
| Plate-shaped pigment 1 (an average particle diameter of 20 μm, an aspect ratio (particle diameter/thickness) of 50, and silica coated). | 50 |
| Wax dispersion A | 300 |
| Ethyl acetate | 800 |

—Preparation of Emulsion or Dispersion—

Two hundred (200) parts of the aqueous medium were placed in a container and stirred with T. K. homomixer from PRIMIX Corp. at 8,500 rpm, and 100 parts of the toner composition liquid A were added to the resultant mixture and mixed for 10 min to prepare an emulsion or a dispersion (emulsified slurry).

Further, the emulsion or the dispersion was stirred for 10 min with a three-one motor at 300 rpm to perform a convergence process. This process aggregates particles smaller than desired to make the particle diameter distribution sharp.

—Removal of Organic Solvent—

A flask equipped with a stirrer and a thermometer was charged with 100 parts of the emulsified slurry, and which was de-solvented at 30° C. for 12 hrs while stirred at a stirring peripheral speed of 20 m/min.

—Washing and Drying—

After subjecting 100 parts of the dispersion slurry to filtration under a reduced pressure, ion-exchanged water (100 parts) was added to the filtration cake, followed by mixing with a T. K. homomixer from PRIMIX Corp. (at 12,000 rpm for 10 min), and then the mixture was filtrated. Ion-exchanged water (300 parts) was added to the obtained filtration cake, followed by mixing with a T. K. homomixer (at 12,000 rpm for 10 min), and then the mixture was filtrated, which was repeated again. Twenty (20) parts of 10% aqueous sodium hydroxide solution was added to the filtration cake, followed by mixing with a T. K. homomixer (at 12,000 rpm for 30 min), and then the resultant mixture was filtrated under a reduced pressure.

Ion-exchanged water (300 parts) was added to the obtained filtration cake, followed by mixing with a T. K. homomixer (at 12,000 rpm for 10 min), and then the mixture was filtrated. Ion-exchanged water (300 parts) was added to the obtained filtration cake, followed by mixing with a T. K. homomixer (at 12,000 rpm for 10 min), and then the mixture was filtrated, which was repeated again. Further, Twenty (20) parts of 10% aqueous sodium hydroxide solution was added to the filtration cake, followed by mixing with a T. K. homomixer (at 12,000 rpm for 10 min), and then the resultant mixture was filtrated under a reduced pressure. Ion-exchanged water (300 parts) was added to the obtained filtration cake, followed by mixing with a T. K. homomixer (at 12,000 rpm for 10 min), and then the mixture was filtrated, which was repeated again to obtain a final filtration cake.

The final filtration cake was dried with an air-circulating drier at 45° C. for 48 hrs, and then was caused to pass through a sieve with a mesh size of 75 μm, to thereby obtain a bright toner base particle 2 having a Mw of 29,000 and a Mn of 2,400.

[Method of Preparing Bright (Pulverization) Toner Base Particle 3]

The procedure for preparation of the bright toner base particle 1 was repeated except for using the following toner materials to prepare a bright toner base particle 3 having a Mw of 29,000 and a Mn of 2,400.

| | |
|---|---|
| Plate-shaped pigment 2 (an average particle diameter of 10 μm, an aspect ratio (particle diameter/thickness) of 50, silica coated, and non-leafing from Toyo Aluminum K. K). | 11 |
| Polyester resin 1 (Mw: 30,000, Mn: 6,600) | 78 |
| Styrene acrylic copolymer (EXD-001 from Sanyo Chemical Industries, Ltd., Tg 68° C., Mw13,000) | 5 |
| Monoester wax (mp 70.5° C.) | 6 |

[Method of Preparing Bright (Pulverization) Toner Base Particle 4]

The procedure for preparation of the bright toner base particle 1 was repeated except for using the following toner materials to prepare a bright toner base particle 4 having a Mw of 29,000 and a Mn of 2,400.

| | |
|---|---|
| Plate-shaped pigment 3 (an average particle diameter of 25 μm, an aspect ratio (particle diameter/thickness) of 50, silica coated, and non-leafing from Toyo Aluminum K. K). | 11 |
| Polyester resin 1 (Mw: 30,000, Mn: 6,600) | 78 |
| Styrene acrylic copolymer (EXD-001 from Sanyo Chemical Industries, Ltd., Tg 68° C., Mw13,000) | 5 |
| Monoester wax (mp 70.5° C.) | 6 |

[Method of Preparing Bright (Pulverization) Toner Base Particle 5]

The procedure for preparation of the bright toner base particle 1 was repeated except for using the following toner materials to prepare a bright toner base particle 5 having a Mw of 29,000 and a Mn of 2,400.

| | |
|---|---|
| Plate-shaped pigment 4 (an average particle diameter of 20 μm, an aspect ratio (particle diameter/thickness) of 20, silica coated, and non-leafing from Toyo Aluminum K. K). | 11 |
| Polyester resin 1 (Mw: 30,000, Mn: 6,600) | 78 |
| Styrene acrylic copolymer (EXD-001 from Sanyo Chemical Industries, Ltd., Tg 68° C., Mw13,000) | 5 |
| Monoester wax (mp 70.5° C.) | 6 |

[Method of Preparing Bright (Pulverization) Toner Base Particle 6]

The procedure for preparation of the bright toner base particle 1 was repeated except for using the following toner materials to prepare a bright toner base particle 6 having a Mw of 29,000 and a Mn of 2,400.

| | |
|---|---|
| Plate-shaped pigment 5 (an average particle diameter of 20 μm, an aspect ratio (particle diameter/thickness) of 125, silica coated, and non-leafing from Toyo Aluminum K. K). | 11 |
| Polyester resin 1 (Mw: 30,000, Mn: 6,600) | 78 |
| Styrene acrylic copolymer (EXD-001 from Sanyo Chemical Industries, Ltd., Tg 68° C., Mw13,000) | 5 |
| Monoester wax (mp 70.5° C.) | 6 |

[Method of Preparing Bright (Pulverization) Toner Base Particle 7]

The procedure for preparation of the bright toner base particle 1 was repeated except for using the following toner materials to prepare a bright toner base particle 7 having a Mw of 15,000 and a Mn of 1,900.

| | |
|---|---|
| Plate-shaped pigment 1 (an average particle diameter of 20 μm, an aspect ratio (particle diameter/thickness) of 50, and silica coated). | 11 |
| Polyester resin 2 (Mw: 16,000, Mn: 3,500) | 78 |
| Styrene acrylic copolymer (EXD-001 from Sanyo Chemical Industries, Ltd., Tg 68° C., Mw13,000) | 5 |
| Monoester wax (mp 70.5° C.) | 6 |

[Method of Preparing Bright (Pulverization) Toner Base Particle 8]

The procedure for preparation of the bright toner base particle 1 was repeated except for using the following toner materials to prepare a bright toner base particle 8 having a Mw of 9,000 and a Mn of 2,200.

| | |
|---|---|
| Plate-shaped pigment 1 (an average particle diameter of 20 μm, an aspect ratio (particle diameter/thickness) of 50, and silica coated). | 11 |
| Polyester resin 3 (Mw: 9,500, Mn: 2,100) | 78 |
| Styrene acrylic copolymer (EXD-001 from Sanyo Chemical Industries, Ltd., Tg 68° C., Mw13,000) | 5 |
| Monoester wax (mp 70.5° C.) | 6 |

[Method of Preparing Bright (Pulverization) Toner Base Particle 9]

The procedure for preparation of the bright toner base particle 1 was repeated except for using the following toner materials to prepare a bright toner base particle 9 having a Mw of 29,000 and a Mn of 2,400.

| | |
|---|---|
| Plate-shaped pigment 1 (an average particle diameter of 20 μm, an aspect ratio (particle diameter/thickness) of 50, and silica coated). | 11 |
| Polyester resin 1 (Mw: 30,000, Mn: 6,600) | 79 |
| Styrene acrylic copolymer (EXD-001 from Sanyo Chemical Industries, Ltd., Tg 68° C., Mw13,000) | 5 |
| Monoester wax (mp 70.5° C.) | 5 |

[Method of Preparing Bright (Pulverization) Toner Base Particle 10]

The procedure for preparation of the bright toner base particle 1 was repeated except for using the following toner materials to prepare a bright toner base particle 10 having a Mw of 29,000 and a Mn of 2,400.

| | |
|---|---|
| Plate-shaped pigment 1 (an average particle diameter of 20 μm, an aspect ratio (particle diameter/thickness) of 50, and silica coated). | 11 |
| Polyester resin 1 (Mw: 30,000, Mn: 6,600) | 74 |
| Styrene acrylic copolymer (EXD-001 from Sanyo Chemical Industries, Ltd., Tg 68° C., Mw13,000) | 5 |
| Monoester wax (mp 70.5° C.) | 10 |

[Method of Preparing Bright (Pulverization) Toner Base Particle 11]

The procedure for preparation of the bright toner base particle 1 was repeated except for using the following toner materials to prepare a bright toner base particle 11 having a Mw of 29,000 and a Mn of 2,400.

| | |
|---|---|
| Plate-shaped pigment 1 (an average particle diameter of 20 μm, an aspect ratio (particle diameter/thickness) of 50, and silica coated). | 11 |
| Polyester resin 1 (Mw: 30,000, Mn: 6,600) | 81 |
| Styrene acrylic copolymer (EXD-001 from Sanyo Chemical Industries, Ltd., Tg 68° C., Mw13,000) | 5 |
| Monoester wax (mp 70.5° C.) | 3 |

[Method of Preparing Bright (Pulverization) Toner Base Particle 12]

The procedure for preparation of the bright toner base particle 1 was repeated except for using the following toner materials to prepare a bright toner base particle 12 having a Mw of 29,000 and a Mn of 2,400.

| | |
|---|---|
| Plate-shaped pigment 1 (an average particle diameter of 20 μm, an aspect ratio (particle diameter/thickness) of 50, and silica coated). | 11 |
| Polyester resin 1 (Mw: 30,000, Mn: 6,600) | 78 |
| Styrene acrylic copolymer (EXD-001 from Sanyo Chemical Industries, Ltd., Tg 68° C., Mw13,000) | 5 |
| Paraffin wax (mp 75.5° C.) | 6 |

[Method of Preparing Bright (Pulverization) Toner Base Particle 13]

The procedure for preparation of the bright toner base particle 1 was repeated except for using the following toner materials to prepare a bright toner base particle 13 having a Mw of 29,000 and a Mn of 2,400.

| | |
|---|---|
| Plate-shaped pigment 6 (an average particle diameter of 9 μm, an aspect ratio (particle diameter/thickness) of 50, silica coated, and non-leafing from Toyo Aluminum K. K). | 11 |
| Polyester resin 1 (Mw: 30,000, Mn: 6,600) | 78 |
| Styrene acrylic copolymer (EXD-001 from Sanyo Chemical Industries, Ltd., Tg 68° C., Mw13,000) | 5 |
| Monoester wax (mp 70.5° C.) | 6 |

[Method of Preparing Bright (Pulverization) Toner Base Particle 14]

The procedure for preparation of the bright toner base particle 1 was repeated except for using the following toner materials to prepare a bright toner base particle 14 having a Mw of 29,000 and a Mn of 2,400.

| | |
|---|---|
| Plate-shaped pigment 7 (an average particle diameter of 27 μm, an aspect ratio (particle diameter/thickness) of 50, silica coated, and non-leafing from Toyo Aluminum K. K). | 11 |
| Polyester resin 1 (Mw: 30,000, Mn: 6,600) | 78 |
| Styrene acrylic copolymer (EXD-001 from Sanyo Chemical Industries, Ltd., Tg 68° C., Mw13,000) | 5 |
| Monoester wax (mp 70.5° C.) | 6 |

[Method of Preparing Bright (Pulverization) Toner Base Particle 15]

The procedure for preparation of the bright toner base particle 1 was repeated except for using the following toner materials to prepare a bright toner base particle 15 having a Mw of 29,000 and a Mn of 2,400.

| | |
|---|---|
| Plate-shaped pigment 8 (an average particle diameter of 20 μm, an aspect ratio (particle diameter/thickness) of 18, silica coated, and non-leafing from Toyo Aluminum K. K). | 11 |
| Polyester resin 1 (Mw: 30,000, Mn: 6,600) | 78 |
| Styrene acrylic copolymer (EXD-001 from Sanyo Chemical Industries, Ltd., Tg 68° C., Mw13,000) | 5 |
| Monoester wax (mp 70.5° C.) | 6 |

[Method of Preparing Bright (Pulverization) Toner Base Particle 16]

The procedure for preparation of the bright toner base particle 1 was repeated except for using the following toner materials to prepare a bright toner base particle 16 having a Mw of 29,000 and a Mn of 2,400.

| | |
|---|---|
| Plate-shaped pigment 9 (an average particle diameter of 20 μm, an aspect ratio (particle diameter/thickness) of 135, silica coated, and non-leafing from Toyo Aluminum K. K). | 11 |
| Polyester resin 1 (Mw: 30,000, Mn: 6,600) | 78 |
| Styrene acrylic copolymer (EXD-001 from Sanyo Chemical Industries, Ltd., Tg 68° C., Mw13,000) | 5 |
| Monoester wax (mp 70.5° C.) | 6 |

-continued

[Method of Preparing Bright (Pulverization) Toner Base Particle 17]

The procedure for preparation of the bright toner base particle 1 was repeated except for using the following toner materials to prepare a bright toner base particle 17 having a Mw of 29,000 and a Mn of 2,400.

| | |
|---|---|
| Plate-shaped pigment 10 (an average particle diameter of 20 μm, an aspect ratio (particle diameter/thickness) of 18, not silica coated, and aluminum flake pigment from Toyo Aluminum K. K). | 11 |
| Polyester resin 1 (Mw: 30,000, Mn: 6,600) | 78 |
| Styrene acrylic copolymer (EXD-001 from Sanyo Chemical Industries, Ltd., Tg 68° C., Mw13,000) | 5 |
| Monoester wax (mp 70.5° C.) | 6 |

[Method of Preparing Bright (Pulverization) Toner Base Particle 18]

The procedure for preparation of the bright toner base particle 1 was repeated except for using the following toner materials to prepare a bright toner base particle 18 having a Mw of 29,000 and a Mn of 2,400.

| | |
|---|---|
| Plate-shaped pigment 11 (an average particle diameter of 20 μm, an aspect ratio (particle diameter/thickness) of 50, not silica coated, and aluminum flake pigment from Toyo Aluminum K. K). | 11 |
| Polyester resin 1 (Mw: 30,000, Mn: 6,600) | 78 |
| Styrene acrylic copolymer (EXD-001 from Sanyo Chemical Industries, Ltd., Tg 68° C., Mw13,000) | 5 |
| Monoester wax (mp 70.5° C.) | 6 |

Each 0.27 parts of hydrophobic silica and hydrophobic titania were externally added to 100 parts of each of the bright toner base particles 1 to 18 to obtain bright toners 1 to 18, the properties which are shown in Table 1.

TABLE 1

| | | | Plate- shaped pigment | | | Temperature width at which | | Pigment |
|---|---|---|---|---|---|---|---|---|
| | Mw | Mn | Average particle diameter (μm) | Aspect ratio (width/height) | Coated with silica | storage modulus G' is $10^2$-$10^4$ (Pa) (° C. 9 | Content of release agent (part) | coated with release agent |
| Toner 1 | 29000 | 2400 | 20 | 50 | Yes | 35 | 5.4 | Yes |
| Toner 2 | 29000 | 2400 | 20 | 50 | Yes | 35 | 5.4 | Yes |
| Toner 3 | 29000 | 2400 | 10 | 50 | Yes | 35 | 6 | Yes |
| Toner 4 | 29000 | 2400 | 25 | 50 | Yes | 35 | 6 | Yes |
| Toner 5 | 29000 | 2400 | 20 | 20 | Yes | 35 | 6 | Yes |
| Toner 6 | 29000 | 2400 | 20 | 125 | Yes | 35 | 6 | Yes |
| Toner 7 | 15000 | 1900 | 20 | 50 | Yes | 30 | 6 | Yes |
| Toner 8 | 9000 | 2200 | 20 | 50 | Yes | 28 | 6 | Yes |
| Toner 9 | 29000 | 2400 | 20 | 50 | Yes | 35 | 5 | Yes |
| Toner 10 | 29000 | 2400 | 20 | 50 | Yes | 35 | 10 | Yes |
| Toner 11 | 29000 | 2400 | 20 | 50 | Yes | 35 | 3 | Yes |
| Toner 12 | 29000 | 2400 | 20 | 50 | Yes | 35 | 6 | No |
| Toner 13 | 29000 | 2400 | 9 | 50 | Yes | 35 | 6 | Yes |
| Toner 14 | 29000 | 2400 | 27 | 50 | Yes | 35 | 6 | Yes |
| Toner 15 | 29000 | 2400 | 20 | 18 | Yes | 35 | 6 | Yes |
| Toner 16 | 29000 | 2400 | 20 | 135 | Yes | 35 | 6 | Yes |

TABLE 1-continued

| | Mw | Mn | Plate- shaped pigment Average particle diameter (μm) | Aspect ratio (width/height) | Coated with silica | Temperature width at which storage modulus G' is $10^2$-$10^4$ (Pa) (° C. 9 | Content of release agent (part) | Pigment coated with release agent |
|---|---|---|---|---|---|---|---|---|
| Toner 17 | 29000 | 2400 | 20 | 18 | No | 35 | 6 | Yes |
| Toner 18 | 29000 | 2400 | 20 | 50 | No | 35 | 6 | Yes |

<Preparation of Two-Component Developer>

<<Preparation of Carrier>>

The following materials were mixed and dispersed by a homomixer for 20 min to prepare a coating liquid. The coating liquid was coated by a fluidized-bed coater on Mn ferrite particles having a weight-average particle diameter of 35 μm to have an average coated thickness of 0.20 μm at 70° C.

| | |
|---|---|
| Silicone Resin (Organo Straight Silicone) | 100 |
| Toluene | 100 |
| γ-(2-aminoethyl)aminopropyltrimethoxysilane | 5 |
| Carbon black | 10 |

The coated particles were burned in an electric oven at 180° C. for 2 hrs and sieved to prepare a carrier.

Each of the bright toners 1 to 18 was uniformly mixed with the carrier by TURBULA MIXER from Willy A. Bachofen (WAB) AG at 48 rpm for 5 min to be charged. Thus, two-component developers 1 to 18 were prepared.

A mixing ratio of the toner to the carrier was 4% by mass in accordance with the toner concentration of the initial developer in the image forming apparatus performing evaluation.

Example 1

The developer 1 using the bright toner 1 was filled in a modified digital full-color multifunctional printer Imagio Neo C600 having a linear speed of 280 mm/sec from Ricoh Company, Ltd. An image was formed on a recording paper COTED glossy (135 g/cm$^2$) from mondi such that the toner had a number density of 115,000 pcs/cm$^2$ and a standard deviation of distances between all adjacent toner particles was 0.48. The image was fixed at 200° C., a fixing NIP time of 46 msec and a fixing NIP pressure of 22 N/cm$^2$, and evaluated according to the following criteria. The evaluation results are shown in Table 2.

<Brightness Evaluation>

The brightness of the image was visually evaluated, based on the following criteria under illumination for color observation (natural daylight illumination) according to JIS K 5600-4-3-: 1999 "Coating general test method-Part 4: visual performance of coating-Section 3: visual comparison of color". Granularity (effect of brilliant brightness) and optical effect (color phase variation at angles) were evaluated. Not less than "fair" is practically usable.

[Evaluation Criteria]

Excellent: good brightness

Good: ordinary brightness

Fair: Slightly blurred brightness

Poor: No brightness

<Brightness-Obtainable Fixable Temperature Width>

Fixed images were formed by the modified digital full-color multifunctional printer Imagio Neo C600 having a linear speed of 280 mm/sec from Ricoh Company, Ltd. Next, the fixing temperature was changed from 130° C. to 200° C. by 5° C. to measure a temperature width in which the above "not less than fair" was obtainable.

[Evaluation Criteria]

Excellent: not less than 30° C.

Good: not less than 20° C. to less than 30° C.

Fair: less than 20° C.

Poor: No brightness-obtainable temperature

Example 2

The evaluation of the developer 1 in Example 1 was repeated except for replacing the developer 1 with the developer 2 using the bright toner 2. The evaluation results are shown in Table 2.

Example 3

The evaluation of the developer 1 in Example 1 was repeated except that developer 1 was replaced with the developer 3 using the bright toner 3 and the image was formed such that the toner had a number density of 125,000 pcs/cm$^2$ on the recording medium. The evaluation results are shown in Table 2.

Example 4

The evaluation of the developer 3 in Example 3 was repeated except for replacing the developer 3 with the developer 4 using the bright toner 4. The evaluation results are shown in Table 2.

Example 5

The evaluation of the developer 3 in Example 3 was repeated except for replacing the developer 3 with the developer 5 using the bright toner 5. The evaluation results are shown in Table 2.

Example 6

The evaluation of the developer 3 in Example 3 was repeated except for replacing the developer 3 with the developer 6 using the bright toner 6. The evaluation results are shown in Table 2.

Example 7

The evaluation of the developer 3 in Example 3 was repeated except for replacing the developer 3 with the developer 7 using the bright toner 7. The evaluation results are shown in Table 2.

Example 8

The evaluation of the developer 3 in Example 3 was repeated except for replacing the developer 3 with the developer 8 using the bright toner 8. The evaluation results are shown in Table 2.

Example 9

The evaluation of the developer 3 in Example 3 was repeated except for replacing the developer 3 with the developer 9 using the bright toner 9. The evaluation results are shown in Table 2.

Example 10

The evaluation of the developer 3 in Example 3 was repeated except for replacing the developer 3 with the developer 10 using the bright toner 10. The evaluation results are shown in Table 2.

Example 11

The evaluation of the developer 3 in Example 3 was repeated except for replacing the developer 3 with the developer 11 using the bright toner 11. The evaluation results are shown in Table 2.

Example 12

The evaluation of the developer 3 in Example 3 was repeated except for replacing the developer 3 with the developer 12 using the bright toner 12. The evaluation results are shown in Table 2.

Example 13

The evaluation of the developer 1 in Example 1 was repeated except that the image was formed such that the toner had a number density of 1,300,000 pcs/cm$^2$ on the recording medium. The evaluation results are shown in Table 2.

Example 14

The evaluation of the developer 1 in Example 1 was repeated except that the image was formed such that the toner had a number density of 84,000 pcs/cm$^2$ on the recording medium. The evaluation results are shown in Table 2.

Example 15

The evaluation of the developer 1 in Example 1 was repeated except that the image was formed such that the toner had a number density of 1,400,000 pcs/cm$^2$ on the recording medium. The evaluation results are shown in Table 2.

Example 16

The evaluation of the developer 1 in Example 1 was repeated except that the image was formed such that the toner had a number density of 80,000 pcs/cm$^2$ on the recording medium. The evaluation results are shown in Table 2.

Example 17

The evaluation of the developer 1 in Example 1 was repeated except that the image was formed such that the standard deviation of distances between all adjacent toner particles was 0.7. The evaluation results are shown in Table 2.

Example 18

The evaluation of the developer 1 in Example 1 was repeated except that the image was formed such that the standard deviation of distances between all adjacent toner particles was 0.86. The evaluation results are shown in Table 2.

Example 19

The evaluation of the developer 1 in Example 1 was repeated except that the image was fixed at mage was fixed at a fixing NIP time of 20 msec. The evaluation results are shown in Table 2.

Example 20

The evaluation of the developer 1 in Example 1 was repeated except that the image was fixed at mage was fixed at a fixing NIP time of 60 msec. The evaluation results are shown in Table 2.

Example 21

The evaluation of the developer 1 in Example 1 was repeated except that the image was fixed at mage was fixed at a fixing NIP time of 18 msec. The evaluation results are shown in Table 2.

Example 22

The evaluation of the developer 1 in Example 1 was repeated except that the image was fixed at mage was fixed at a fixing NIP time of 65 msec. The evaluation results are shown in Table 2.

Example 23

The evaluation of the developer 1 in Example 1 was repeated except that the image was fixed at mage was fixed at a fixing NIP pressure of 15 N/cm$^2$. The evaluation results are shown in Table 2.

Example 24

The evaluation of the developer 1 in Example 1 was repeated except that the image was fixed at mage was fixed at a fixing NIP pressure of 30 N/cm$^2$. The evaluation results are shown in Table 2.

Example 25

The evaluation of the developer 1 in Example 1 was repeated except that the image was fixed at mage was fixed at a fixing NIP pressure of 12 N/cm$^2$. The evaluation results are shown in Table 2.

Example 26

The evaluation of the developer 1 in Example 1 was repeated except that the image was fixed at mage was fixed at a fixing NIP pressure of 32 N/cm$^2$. The evaluation results are shown in Table 2.

Comparative Example 1

The evaluation of the developer 3 in Example 3 was repeated except for replacing the developer 3 with the developer 13 using the bright toner 13. The evaluation results are shown in Table 2.

Comparative Example 2

The evaluation of the developer 3 in Example 3 was repeated except for replacing the developer 3 with the developer 14 using the bright toner 14. The evaluation results are shown in Table 2.

Comparative Example 3

The evaluation of the developer 3 in Example 3 was repeated except for replacing the developer 3 with the developer 15 using the bright toner 15. The evaluation results are shown in Table 2.

Comparative Example 4

The evaluation of the developer 3 in Example 3 was repeated except for replacing the developer 3 with the developer 16 using the bright toner 16. The evaluation results are shown in Table 2.

Comparative Example 5

The evaluation of the developer 3 in Example 3 was repeated except for replacing the developer 3 with the developer 17 using the bright toner 17. The evaluation results are shown in Table 2.

Comparative Example 6

The evaluation of the developer 3 in Example 3 was repeated except for replacing the developer 3 with the developer 18 using the bright toner 18. The evaluation results are shown in Table 2.

TABLE 2

| | | Conditions on Recording Medium | | | | Evaluation Result | |
|---|---|---|---|---|---|---|---|
| | | | Standard Deviation of Fixing Conditions | | | | |
| | | Toner Number Density (pcs/cm$^2$) | Distances between Toner Particles | Fixing Nip Time (ms) | Fixing Pressure (N/cm$^2$) | Brightness | Brightness-Obtainable Fixable Temperature Width |
| Example 1 | Toner 1 | 115000 | 0.48 | 46 | 22 | Excellent | Excellent |
| Example 2 | Toner 2 | 115000 | 0.48 | 46 | 22 | Excellent | Excellent |
| Example 3 | Toner 3 | 125000 | 0.48 | 46 | 22 | Good | Excellent |
| Example 4 | Toner 4 | 125000 | 0.48 | 46 | 22 | Good | Excellent |
| Example 5 | Toner 5 | 125000 | 0.48 | 46 | 22 | Fair | Excellent |
| Example 6 | Toner 6 | 125000 | 0.48 | 46 | 22 | Fair | Excellent |
| Example 7 | Toner 7 | 125000 | 0.48 | 46 | 22 | Good | Good |
| Example 8 | Toner 8 | 125000 | 0.48 | 46 | 22 | Fair | Fair |
| Example 9 | Toner 9 | 125000 | 0.48 | 46 | 22 | Good | Good |
| Example 10 | Toner 10 | 125000 | 0.48 | 46 | 22 | Good | Good |
| Example 11 | Toner 11 | 125000 | 0.48 | 46 | 22 | Fair | Fair |
| Example 12 | Toner 12 | 125000 | 0.48 | 46 | 22 | Fair | Good |
| Example 13 | Toner 1 | 1300000 | 0.48 | 46 | 22 | Good | Excellent |
| Example 14 | Toner 1 | 84000 | 0.48 | 46 | 22 | Good | Excellent |
| Example 15 | Toner 1 | 1400000 | 0.48 | 46 | 22 | Fair | Excellent |
| Example 16 | Toner 1 | 80000 | 0.48 | 46 | 22 | Fair | Excellent |
| Example 17 | Toner 1 | 115000 | 0.7 | 46 | 22 | Good | Excellent |
| Example 18 | Toner 1 | 115000 | 0.86 | 46 | 22 | Fair | Excellent |
| Example 19 | Toner 1 | 115000 | 0.48 | 20 | 22 | Good | Good |
| Example 20 | Toner 1 | 115000 | 0.48 | 60 | 22 | Good | Good |
| Example 21 | Toner 1 | 115000 | 0.48 | 18 | 22 | Fair | Fair |
| Example 22 | Toner 1 | 115000 | 0.48 | 65 | 22 | Fair | Fair |
| Example 23 | Toner 1 | 115000 | 0.48 | 46 | 15 | Good | Good |
| Example 24 | Toner 1 | 115000 | 0.48 | 46 | 30 | Good | Good |
| Example 25 | Toner 1 | 115000 | 0.48 | 46 | 12 | Fair | Fair |
| Example 26 | Toner 1 | 115000 | 0.48 | 46 | 32 | Fair | Fair |
| Comparative Example 1 | Toner 13 | 125000 | 0.48 | 46 | 22 | Poor | Poor |
| Comparative Example 2 | Toner 14 | 125000 | 0.48 | 46 | 22 | Poor | Poor |

TABLE 2-continued

| | | Conditions on Recording Medium | | | | Evaluation Result | |
|---|---|---|---|---|---|---|---|
| | | | Standard Deviation of | Fixing Conditions | | | Brightness- |
| | | Toner Number Density (pcs/cm$^2$) | Distances between Toner Particles | Fixing Nip Time (ms) | Fixing Pressure (N/cm$^2$) | Brightness | Obtainable Fixable Temperature Width |
| Comparative Example 3 | Toner 15 | 125000 | 0.48 | 46 | 22 | Poor | Poor |
| Comparative Example 4 | Toner 16 | 125000 | 0.48 | 46 | 22 | Poor | Poor |
| Comparative Example 5 | Toner 17 | 125000 | 0.48 | 46 | 22 | Poor | Poor |
| Comparative Example 6 | Toner 17 | 125000 | 0.48 | 46 | 22 | Poor | Poor |

Having now fully described the invention, it will be apparent to one of ordinary skill in the art that many changes and modifications can be made thereto without departing from the spirit and scope of the invention as set forth therein.

What is claimed is:

1. A toner, comprising:

a binder resin; and a plate-shaped pigment having a silica coated layer on a surface thereof, and having an average particle diameter of from 10 μm to 25 μm, and an aspect ratio of from 20 to 125.

2. The toner of claim 1, wherein the toner satisfies the following relation:

$$T2-T1 \geq 30° C.$$

wherein

T1 is a temperature at which the toner has a storage modulus G' of $1 \times 10^4$ (Pa); and T2 is a temperature at which the toner has a storage modulus G' of $1 \times 10^2$ (Pa).

3. A toner housing unit housing the toner according to claim 1.

4. An image forming apparatus, comprising:

an electrostatic latent image bearer;

an electrostatic latent image former configured to form an electrostatic latent image on the electrostatic latent image bearer;

an image developer comprising the toner according to claim 1 and configured to form a toner image on the electrostatic latent image bearer;

a transferer configured to transfer the toner image onto a surface of a recording medium; and a fixer to fix the toner image on a surface of the recording medium.

5. An image forming method, comprising:

forming an electrostatic latent image on an electrostatic latent image bearer;

developing the electrostatic latent image with the toner according to claim 1 to form a toner image on the electrostatic latent image bearer;

transferring the toner image onto the surface of a recording medium; and fixing the toner image on the surface of the recording medium, wherein the toner on the recording medium, before fixation, has a number density of from 84,000 pieces/cm$^2$ to 1,400,000 pieces/cm$^2$ and a standard deviation of distances between the toner particles not greater than 0.7.

6. The image forming method of claim 5, wherein the fixing of the toner image comprises fixing the toner image on the surface of the recording medium for a fixing nip time of from 20 ms to 60 ms and at a fixing pressure of from 15 N/cm$^2$ to 30 N/cm$^2$.

7. The toner of claim 1, wherein the toner has a weight-average molecular weight (Mw) of 9,000-29,000 and a number-average molecular weight (Mn) of 1,900 to 2,400.

8. The toner of claim 7, wherein the weight-average molecular weight (Mw) of the toner is 29,000 and the number-average molecular weight (Mn) of the toner is 2,400.

* * * * *